US009200415B2

(12) United States Patent
Graham et al.

(10) Patent No.: US 9,200,415 B2
(45) Date of Patent: Dec. 1, 2015

(54) PAVING MACHINE WITH AUTOMATICALLY ADJUSTABLE SCREED ASSEMBLY

(71) Applicant: Caterpillar Paving Products Inc., Minneapoils, MN (US)

(72) Inventors: Luke E. Graham, Maple Grove, MN (US); Toby A. Frelich, Saint Michael, MN (US); Jameson M. Smieja, Mound, MN (US); Ricky L. Mings, Andover, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 92 days.

(21) Appl. No.: 14/083,685

(22) Filed: Nov. 19, 2013

(65) Prior Publication Data

US 2015/0139729 A1 May 21, 2015

(51) Int. Cl.

| | |
|---|---|
| ***E01C 19/42*** | (2006.01) |
| ***E01C 19/22*** | (2006.01) |
| ***E01C 19/40*** | (2006.01) |
| ***E01C 23/07*** | (2006.01) |

(52) U.S. Cl.

CPC ..... *E01C 19/42* (2013.01); *E01C 19/22* (2013.01); *E01C 19/40* (2013.01); *E01C 23/07* (2013.01)

(58) Field of Classification Search

CPC ..... E01C 19/22; E01C 19/40; E01C 19/42; E01C 23/07

USPC ..... 404/84.05–84.8

See application file for complete search history.

(56) References Cited

U.S. PATENT DOCUMENTS

| | | | | |
|---|---|---|---|---|
| 4,473,319 | A * | 9/1984 | Spangler | 404/72 |
| 4,722,636 | A | 2/1988 | Brock | |
| 4,759,657 | A * | 7/1988 | Dorr et al. | 404/72 |
| 5,533,828 | A * | 7/1996 | Campbell | 404/75 |
| 6,238,135 | B1 | 5/2001 | Rower | |
| RE39,834 | E * | 9/2007 | Kieranen et al. | 404/84.5 |
| 7,654,769 | B2 | 2/2010 | Herrmann | |
| 8,079,776 | B2 * | 12/2011 | Lossow | 404/84.5 |
| 8,371,769 | B2 | 2/2013 | Worsley et al. | |
| 8,388,263 | B2 * | 3/2013 | Fritz et al. | 404/84.2 |
| 8,454,266 | B2 * | 6/2013 | Buschmann et al. | 404/72 |
| 8,894,323 | B2 * | 11/2014 | Rutz et al. | 404/84.05 |
| 8,998,530 | B2 * | 4/2015 | Buschmann et al. | 404/84.05 |
| 2007/0044088 | A1 * | 2/2007 | Eul | 717/174 |
| 2007/0050137 | A1 * | 3/2007 | Woon et al. | 701/219 |
| 2010/0215433 | A1 * | 8/2010 | Fritz | 404/84.5 |
| 2010/0296866 | A1 * | 11/2010 | Braun et al. | 404/79 |
| 2011/0229264 | A1 * | 9/2011 | Weiser | 404/72 |
| 2012/0288328 | A1 * | 11/2012 | Minich | 404/72 |
| 2012/0321385 | A1 * | 12/2012 | Hanfland | 404/84.1 |

* cited by examiner

*Primary Examiner* — Raymond W Addie
(74) *Attorney, Agent, or Firm* — Andrew A. Phillips

(57) ABSTRACT

A method for preparing a screed assembly for starting a new paving operation is provided. The screed assembly is reset to a pre-stored screed position in response to a user command. A user defined paving depth associated with the new paving operation is received. The screed assembly is positioned to rest on a paving surface and to a float mode in response to a user command. An angle of attack of the screed assembly associated with the new paving operation is set in response to a user command. Further, a height of the screed assembly is adjusted based on the user defined paving depth. A confirmation message indicative of the screed assembly prepared for the new paving operation is provided to a user.

22 Claims, 4 Drawing Sheets

PAVING MACHINE WITH AUTOMATICALLY ADJUSTABLE SCREED ASSEMBLY

TECHNICAL FIELD

This patent disclosure relates generally to paving machines with a screed assembly and, more particularly, to a system and method for preparing the screed assembly for a paving operation.

BACKGROUND

Paving machines are used to apply, spread, and compact a mat of paving material relatively evenly over a desired paving surface. These machines are regularly used in construction of roads, parking lots, and other areas where a smooth durable surface is required for cars, trucks, and other vehicles to travel. An asphalt-paving machine generally includes a tractor and a screed assembly. The tractor has a hopper for receiving asphalt material from a truck and a conveyor system for transferring the asphalt rearwardly from the hopper for discharge onto a roadbed. Screw augers may be used to spread the asphalt transversely across the roadbed in front of a screed assembly. The screed assembly includes a screed plate that smoothens and compacts the asphalt material and leaves a roadbed of uniform depth and smoothness.

In order to help achieve the desired uniform depth and smoothness as well as to accommodate different job site conditions and different desired roadbed characteristics, the tractor and the screed assembly may be configured differently based on the requirements of a particular job. Some of the tractor and screed assembly functions that need to be configured differently may include paving depth, angle of attack, etc. However, these adjustments may make setting up the screed assembly at the start of a new operation a time consuming and labor intensive process, leading to inefficiencies. Generally, a shimming plate is placed below the screed plate to prepare the screed assembly for starting a new paving operation, which is further removed when the adjustment is completed. Moreover, the set-up of the screed assembly using such shimming plates is relatively complicated, which may lead to errors in the set-up. These errors may result in defects in the mat such as inconsistencies or discontinuities in the compression of the mat and in the thickness, texture, density and smoothness of the mat.

U.S. Pat. No. 6,238,135 relates to a paver having a chassis and a trailing floating screed which is articulated on the chassis by a pair of tension arms. The setting angle of the screed relative to the ground is capable of being adjusted via actuating cylinders. The screed includes at least one tamper bar that is movable in upward and downward directions by a drive and having a variable number of strokes. Further, the screed has a bottom-side smoothing plate. At least one sensor configured for measuring the setting angle is provided in the vicinity of the rear end of the screed. The sensor is connected to an associated controller which is capable of adjusting the number of strokes or stroke rate of the tamper bar in order to adjust the setting angle of the screed to a predetermined desired value.

However, to setup the screed assembly for a new paving operation every time, there is a need for an improved automated system to minimize any adjustment and calibration errors and to avoid any unintentional omission of steps of adjusting the screed assembly.

SUMMARY

In one aspect, a method for preparing a screed assembly for starting a new paving operation is provided. The screed assembly is reset to a pre-stored screed position in response to a user command. A user defined paving depth associated with the new paving operation is received. The screed assembly is positioned to rest on a paving surface and a float mode is activated in response to received user commands. An angle of attack associated with the new paving operation is set for the screed assembly in response to a received user command. Further, a height of the screed assembly is adjusted based on the user defined paving depth. A confirmation message indicating that the screed assembly is prepared for the new paving operation.

In another aspect, a paving machine is provided. The paving machine includes a screed assembly, a plurality actuators associated with the screed assembly, a plurality of sensors, a user interface and a controller in communication with the sensors and the user interface. The plurality of actuators are configured to adjust a position of the screed assembly. The plurality of sensors are configured to sense a respective position parameters associated with the plurality of actuators, the position parameters indicative of the position of the screed assembly. The user interface is used to prepare the screed assembly for a new paving operation. The user interface is configured to facilitate a user to provide a user command to start the new paving operation. The user interface further facilitates the user to provide a user command to reset the screed assembly to a pre-stored screed position and provide a user command to position the screed assembly to rest on a paving surface and to a float mode. Furthermore, the user interface facilitates the user to provide a user command to set the screed assembly based on an angle of attack associated with the new paving operation. Additionally, the user interface facilitates the user to define a paving depth associated with the new paving operation. The controller is configured to receive one or more sensed position parameter from the plurality of sensors associated with the screed assembly. The controller determines a first reference position of the screed assembly based on the sensed position parameter from the plurality of sensors when the screed assembly is in the float mode. The controller further determines a second reference position of the screed assembly based on the user defined paving depth and the pre-defined angle of attack. Furthermore, the controller is configured to adjust an amount of pressure applied to the plurality of actuators associated with the screed assembly based on the first reference position and the second reference position to set the screed assembly to the second reference position and to prepare the screed assembly for the new paving operation.

In a yet another aspect, a paving machine is provided. The paving machine includes a screed assembly, a plurality of tow arms, lift cylinders having respective actuators associated with the screed assembly, a user interface and a controller in communication with the user interface. The tow arms, the lift cylinders and the respective actuators are configured to adjust a position of the screed assembly. The user interface is used to prepare the screed assembly for a new paving operation. The user interface is configured to facilitate a user to provide a user command to start the new paving operation. The user interface further facilitates the user to provide a user command to reset the screed assembly to a pre-stored screed position and provide a user command to position the screed assembly to rest on a paving surface and to a float mode. Furthermore, the user interface facilitates the user to provide a user command to set the screed assembly based on an angle of attack associated with the new paving operation. Additionally, the user interface facilitates the user to define a paving depth associated with the new paving operation. The controller is configured to adjust a pressure supplied to the actuators associated with the tow arms and the lift cylinders. The pressure supplied to the actuators is adjusted to reset the screed assembly to the pre-stored screed position in response to the user command to set the screed assembly to the pre-stored screed position. The controller is configured to adjust the pressure supplied to the actuators to position the screed assembly to rest on the paving surface and to the float mode in response to the user command to position the screed assembly to rest on the paving surface and to the float mode. The controller is configured to adjust the pressure supplied to the actuators to set the screed assembly based on a angle of attack associated with the new paving operation in response to the user command to set the screed assembly based on the angle of attack associated with the new paving operation. Furthermore, the controller is configured to adjust the pressure supplied to the actuators to adjust a height of the screed assembly based on the user defined paving depth.

DETAILED DESCRIPTION

Figure 1:
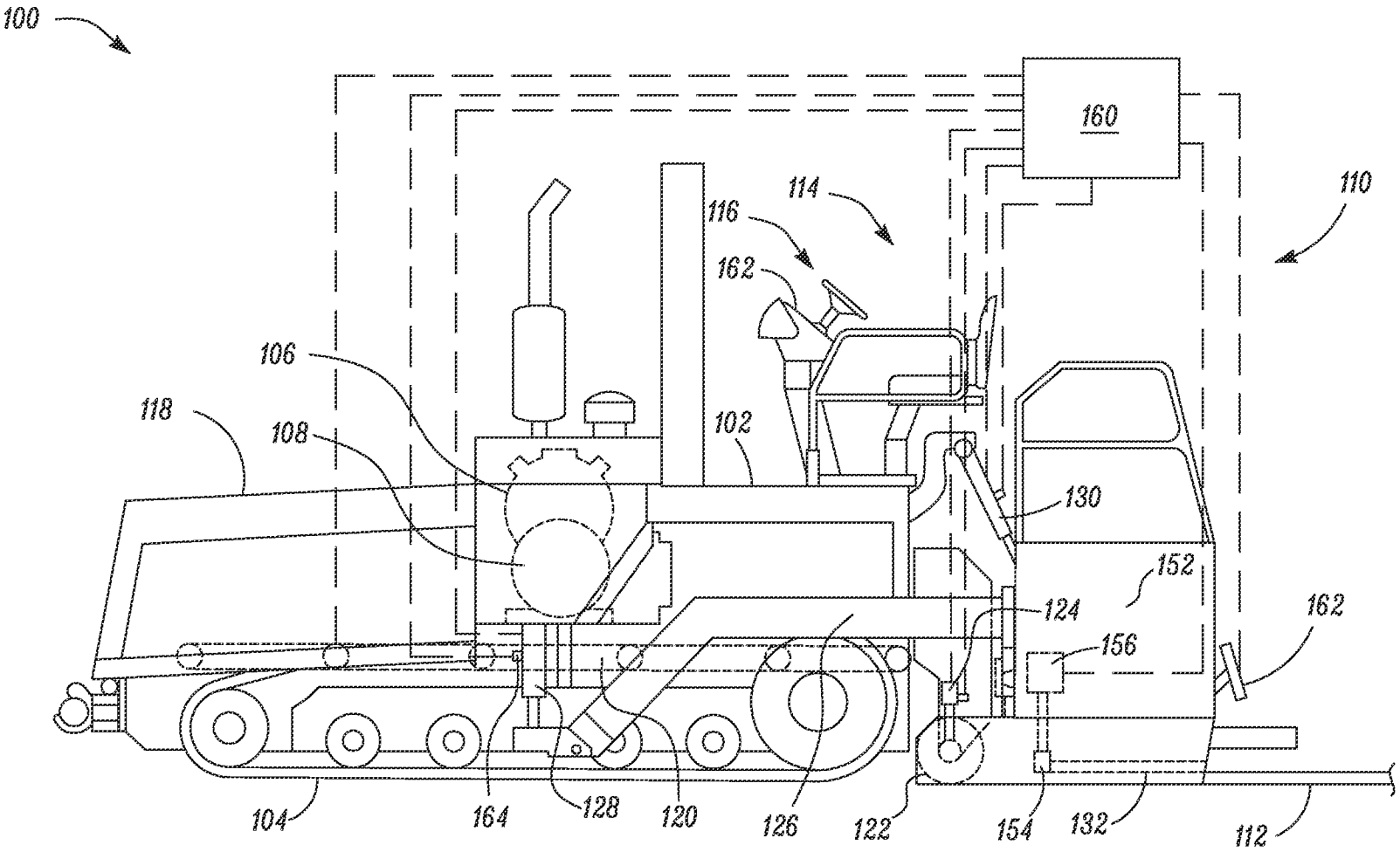
FIG. 1 is a diagrammatic side view of a paving machine having an adjustable screed assembly in accordance with the present disclosure.

This disclosure generally relates to an automatically adjustable screed assembly of a paving machine. FIG. 1 illustrates an exemplary machine 100, shown as a paving machine. The machine 100 includes a frame 102 with a set of ground-engaging elements 104, such as wheels or tracks, coupled with the frame 102. The ground engaging elements 104 are driven by an engine 106 in a conventional manner. The engine 106 further drives an associated generator 108 that is used to power various systems on the machine 100. A screed assembly 110 is attached at a rear end of the machine 100 to spread and compact paving material into a layer or mat 112 of desired thickness, size and uniformity on a paving surface. The machine 100 also includes an operator station 114 having a seat and a console 116, which may include various controls for directing operations of the machine 100.

The machine 100 further includes a hopper 118 configured to store a paving material, and a conveyor system including one or more conveyors 120 configured to move the paving material from the hopper 118 to the screed assembly 110. The conveyors 120 are arranged at a bottom of the hopper 118 and, if more than one is provided, may be positioned side-by-side and run parallel to one another back to the rear of the machine 100. The speed of the one or more conveyors 120 is adjustable in order to control the rate at which paving material may be delivered to the screed assembly 110. More specifically, the height of the pile of paving material delivered to the screed assembly 110 may be increased or decreased by varying the conveyor speed relative to the speed at which the machine 100 is traveling. To the extent that more than one conveyor 120 is provided, the speed of each conveyor 120 may be independently variable in order to adjust the amount of paving material delivered to each side of the screed assembly 110. While an endless path conveyor is shown, one or more feed augers or other material feed components may be used instead of or in addition to the conveyor 120.

One or more augers 122 are arranged near the forward end of the screed assembly 110 to receive the paving material supplied by the conveyor 120 and spread the material evenly beneath the screed assembly 110. Although only one auger 122 is shown in FIG. 1, the machine 100 may have a single auger or any number of augers. If the machine 100 includes multiple augers 122, the augers 122 may be aligned end-to-end, and situated crossways within the screed assembly 110. To the extent multiple augers 122 are provided, each auger may be independently controlled in order to control the output of machine 100. For example, differing auger settings may be used to compensate for imbalances in the delivery of paving material to the screed assembly 110 or even to create desired imbalances in the output of the machine 100.

The height of the auger 122 is also adjustable via one or more height adjustment actuators 124. The height adjustment actuators 124 for the auger 122 may be any suitable actuator, such as, for example, hydraulic cylinders. The auger height may be adjusted in order to position the auger 122 at the proper height to sufficiently spread the paving material. For example, if the auger 122 is too high, the paving material may not be sufficiently spread and the screed assembly 110 may not be able to smooth it out completely. On the other hand, if the auger 122 is too low, it may disrupt the paving material such that there may not be enough material for the screed assembly 110 to smooth and compact.

As shown in FIG. 1, the screed assembly 110 is pivotally connected behind the machine 100 by a pair of tow arms 126 (only one of which is visible in FIG. 1) that extend between the frame 102 of the machine 100 and the screed assembly 110. The tow arms 126 are pivotally connected to the frame 102 such that the relative position and orientation of the screed assembly 110 relative to the frame 102, and the paving surface, may be adjusted by pivoting the tow arms 126 in order, for example, to control the thickness of paving material deposited via the machine 100, such as a paving depth. To this end, tow arm actuators 128 are provided that are arranged and configured to raise and lower the tow arms 126 and thereby raise and lower the screed assembly 110. The tow arm actuators 128 may be any suitable actuators, such as, for example, hydraulic actuators. To provide further control over the paving process, screed lift cylinders 130 may be provided that are configured such that the hydraulic pressure in the lift side of actuators, which may be referred to as the screed assist pressure, is adjustable during the paving process in order to allow the downward force applied by the screed assembly 110 to be varied.

Figure 2:
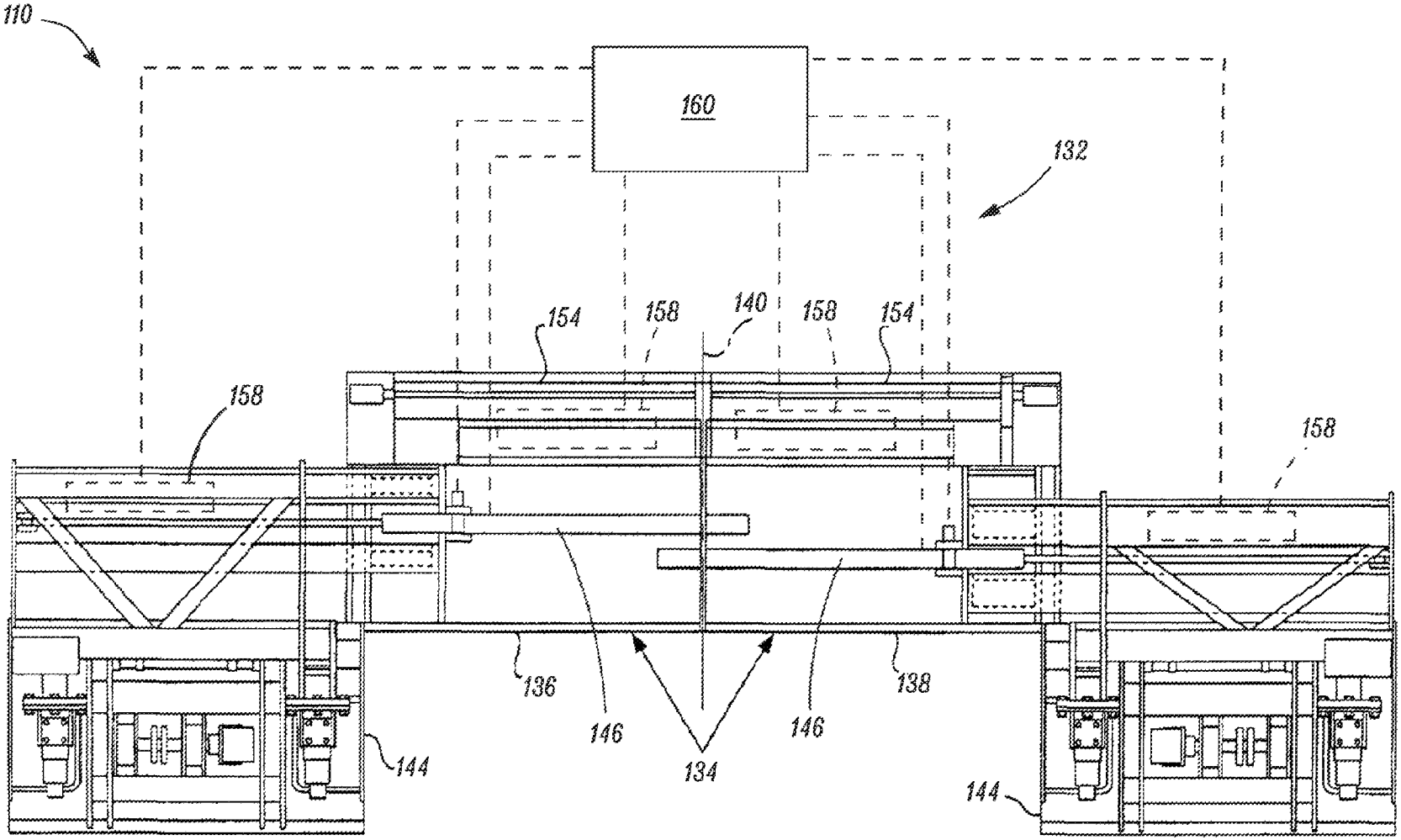
FIG. 2 is a plan view of the screed assembly of FIG. 1.

The screed assembly 110 may be any of a number of configurations known in the art such as a fixed width screed, screed extender, or a multiple section screed that includes extensions. As shown in FIG. 2, the screed assembly 110 is provided with a screed plate 132 including a main screed section 134 with a left and a right screed section 136, 138. The left and right screed sections 136, 138 are connected to one another along a longitudinal centerline 140 in a manner so as to be capable of being disposed at a slight angle relative to each other in order to execute a crowning of the paving surface about the centerline or various other operations. A crown actuator 142 (see FIG. 3), such as a hydraulic or other suitable actuator, is provided that is arranged and configured to be able to pivot the left and right screed sections 136, 138 relative to each other about the centerline 140 to produce the desired crown.

Figure 3:
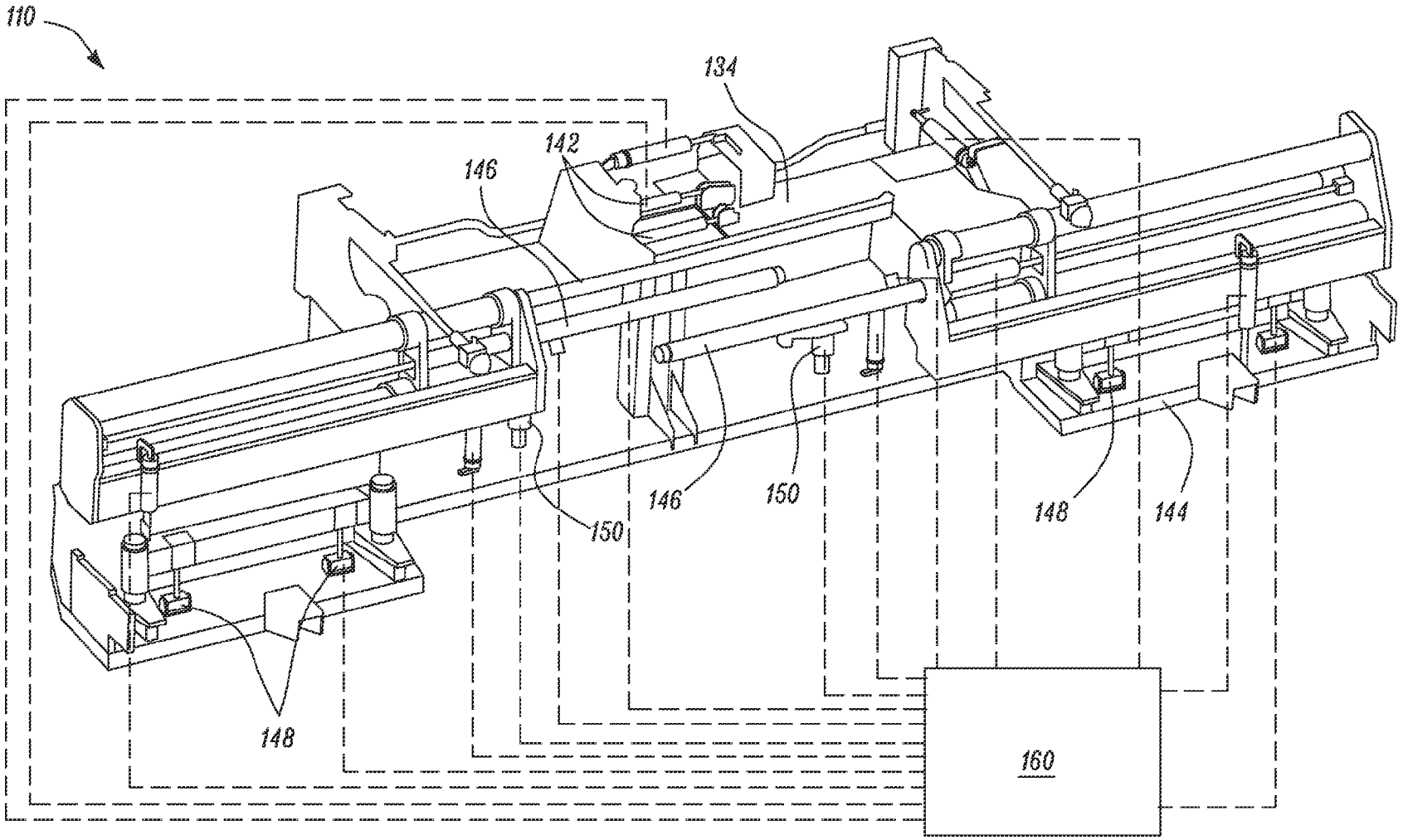
FIG. 3 is a perspective view of the screed assembly of FIG. 1.

As further shown in FIG. 2, a screed extender 144 is provided behind and adjacent to each of the left and right screed sections 136, 138. However, the screed extenders 144 also may be positioned in front of the main screed section 134. The screed extenders 144 are slidably movable laterally relative to the main screed section 134 between retracted and extended positions so that varying widths of paving material may be laid. As shown in FIGS. 2 and 3, the lateral movement of the extenders 144 relative to the main screed section 134 is driven by respective powered screed width actuators 146, such as hydraulic or electric actuators. In addition to being movable laterally relative to the main screed section 134, the screed extenders 144 may also be configured and supported such that their height and slope may be adjusted relative to the paving surface. As shown in FIG. 3, the height of the screed extenders 144 and the slope of the screed extenders 144 may be adjusted by respective powered height actuators 148 and slope actuators 150 (one of which is seen in FIG. 3 with the other being similarly arranged with respect to the respective screed width actuator 146), such as a hydraulic or electric actuators.

The screed assembly 110 also includes a tamper bar assembly 152 positioned forward of the main screed section 134 and extending transversely to the direction of travel of the machine 100, as shown in FIG. 1, to provide some compaction of the paving material before it is engaged by the screed plate 132. The tamper bar assembly 152 includes a tamper bar 154 that may be an elongated generally rectangular member with a generally flat paving material engagement surface along a lower edge thereof. The tamper bar 154 is supported so as to be movable up and down and so as to be able to strike the paving surface after it is deposited by the auger 122. This upward and downward movement of the tamper bar 154 may be powered by a tamper bar drive mechanism 156 that includes one or more tamper bar drive members operatively connected to the tamper bar 154 that are configured to be driven by one more eccentric sections of a drive shaft. To further aid in compaction of the paving material, the screed assembly 110 includes vibratory mechanisms 158 (shown schematically in FIG. 2) arranged on the upper side of the screed plate 132, including the screed extenders 144, and configured to drive a vibratory movement of the screed plate 132.

In an exemplary embodiment, a controller 160 is provided to coordinate and control the various systems and components associated with the machine 100 and prepare the screed assembly 110 for a new paving operation. The controller 160 is configured to monitor various operating parameters and to responsively regulate various variables and functions affecting operation of the machine 100. The controller 160 may include a microprocessor, an application specific integrated circuit ("ASIC"), or other appropriate circuitry and may have memory or other data storage capabilities. The controller 160 may include functions, steps, routines, data tables, data maps, charts and the like saved in and executable from read only memory to control the machine 100. Although in FIGS. 1-3, the controller 160 is illustrated as a single, discrete unit, in other embodiments the controller and its functions may be distributed among a plurality of distinct and separate components. To receive operating parameters and send control commands or instructions, the controller 160 may be operatively associated with and may communicate with various sensors and controls on the machine 100 as described in greater detail below. Communication between the controller 160 and the sensors may be established by sending and receiving digital or analog signals across electronic communication lines or communication busses, including by wireless communication. In FIGS. 1-3, the various communication and command channels are indicated in dashed lines for illustration purposes.

In order to allow users of the machine 100 to enter and receive information concerning operation of the machine 100, configuration of the screed assembly 110 etc., one or more user interfaces 162 may be provided that are in communication with the controller 160. For example, the user interface 162 may be provided at the operator station 114 to be accessible to a user sitting in the operator station 114. In an exemplary embodiment, the user interface 162 may be a graphical user interface provided on a display (not shown), hereinafter referred to as the graphical user interface 162. The display may be any kind of display suitable for showing information to a user of the machine 100. It may be contemplated, that the machine 100 may include multiple user interfaces, such as on the operation station 114, on the screed assembly 110, etc., and any of the user interfaces 162 may be used to enter and receive information concerning the operation of the machine 100. In an alternative embodiment, the user interfaces 162 may be provided at a remote location external to the machine 100 for controlling and operating the machine 100 in an autonomous mode.

In an exemplary embodiment, the graphical user interface 162 may facilitate a user to prepare the screed assembly 110 for a paving operation. For example, a user inputs a "start new paving operation" command displayed on the graphical user interface 162 to start a new paving operation (e.g., a new job site or a new mat pull). Subsequently, the user activates a pre-stored screed position, such as default settings, of the screed assembly 110 by activating an "Activate default settings" command displayed on the graphical user interface 162. In response, the controller 160 automatically adjusts the screed assembly 110 to default settings prior to starting the new paving operation. For example, the default settings may be factory default settings as set by a manufacturer of the screed assembly, or may be defined by the user of the machine 100. If the controller 160 determines that there has been paving operation performed by the screed assembly 110 after the last activated default settings, then the user may be prompted to again activate the default settings of the screed assembly 110. However, if the controller 160 determines that there has been no paving operation performed since the last activated default settings, then the controller 160 may omit this step, as the screed assembly 110 would already be in the default settings mode. In an embodiment, in the pre-stored screed position, the screed assembly 110 may be positioned angularly, (i.e., at a pre-defined angle) with respect to the paving surface. In an alternative embodiment, in the pre-stored screed position the screed assembly 110 may be positioned straight on the paving surface.

The controller 160 is further configured to display a number of sequential requests to the user to provide a number of user defined configuration parameters via the graphical user interface 162. The user may submit the desired configuration parameters by entering the desired configuration parameter and activating a "Submit" command displayed on the graphical user interface 162. In response to the "Submit" command, the controller 160 receives the number of user defined configuration parameters of the screed assembly 110 for starting the new paving operation. Examples of the configuration parameters may include paving depth of the screed assembly 110.

Further, the controller 160 is configured to communicate with various sensors on the screed assembly 110 to receive the sensed position parameters associated with the screed assembly 110. In an exemplary embodiment, the controller 160 communicates with one or more tow arm position sensors 164 configured to monitor the position of the tow arms 126. Additionally, the controller 160 is configured to communicate with a lift cylinder sensor 168 to monitor the position of the screed lift cylinders 130. The controller 160 further communicates with one or more width position sensors 147 associated with the screed width actuators 146 of the main screed section 134 to monitor the width position of the screed assembly 110. The controller 160 also communicates with one or more extender height sensors 149 and extender slope sensors 151 associated with the height actuators 148 and the slope actuators 150 of the screed extenders 144. The extender height sensors 149 and the extender slop sensors 151 are configured to monitor height position and slope position of the screed extender 144 respectively. The controller 160 may also communicate with a crown position sensor 143 configured to monitor the position of the crown actuator 142.

In order to make set-up of the screed assembly 110 prior to the start of the new paving operation quicker and easier, the controller 160 is configured to automatically adjust the position of the screed assembly 110 to correspond to the user defined position parameters received via the graphical user interface 162. For example, upon receiving the user defined position parameters of the screed assembly 110, the controller 160 may automatically direct the various actuators associated with the screed assembly 110 to perform any adjustments in the position of the screed assembly 110 that are necessary to make the position of the screed assembly 110 match the user defined position parameters. The controller 160 may be configured to control the tow arm actuators 128 to automatically adjust the position of the tow arms 126, and the screed lift cylinders 130 to adjust the configuration of the screed assembly 110, such that the position of the screed assembly 110 corresponds to the user defined position parameters. Additionally, the controller 160 may also control the height actuators 148 and the slope actuators 151 associated with the screed extender 144 to correspond to the user defined position parameters of the screed assembly 110. For example, the controller 160 may communicate with valves associated with the respective actuators to control the tow arm actuators 128, the height actuators 148 and the slope actuators 151. These valves may be hydraulically, pneumatically and/or electrically operated valves. The controller 160 may also control the crown actuator 142 to achieve a desired crown based on the user defined configuration parameters of the screed assembly 110.

In an embodiment, the controller 160 is configured to prompt a request to the user to provide a user defined paving depth, via the graphical user interface 162. Subsequently, the graphical user interface 162 facilitates the user to define the user defined paving depth and the user submits the desired paving depth by activating the "Submit" command displayed on the graphical user interface 162.

The controller 160 is configured to prompt the user to adjust the position of the screed assembly 110 such that the screed plate 132 of the screed assembly 110 rests appropriately on the paving surface, prior to starting the screed assembly 110 for the new paving operation. In response to the user command, the controller positions the screed assembly 110 to rest appropriately on the paving surface. The user may manually check and confirm the same by activating a "Confirm" command displayed on the graphical user interface 162. Further, the user may activate a float mode of the screed assembly 110. In response, the controller 160 is configured to automatically adjust the screed lift cylinders 130 to the float mode, to facilitate the screed assembly 110 to float freely on the paving surface for the paving operation. In an exemplary embodiment, the controller 160 stores a position of the screed lift cylinder 130 in the float mode as a first reference position.

Further, the controller 160 may then generate an alarm to indicate to the user of the machine 100, and others working and/or standing in the vicinity of the machine 100, that adjustment of the screed assembly 110 is going on for the paving operation to start. The alarm may be an audio alarm, an audio-visual alarm, a textual alarm, etc.

In an embodiment, the controller 160 may determine a second reference position of the screed assembly 110 corresponding to the user defined paving depth and the angle of attack of the screed assembly. Furthermore, the controller 160 adjusts a height of the screed assembly based on the user defined paving depth. For example, the controller adjusts the tow arms 126 and the lift cylinders 130 to position a trailing edge of the screed plate 132 at the desired paving depth and predetermined and/or pre-programmed angle of attack with respect to the paving surface. For example, the angle of attack may be defined as a factory default value. The angle of attack is defined as an angle of the screed plate 132 with respect to the paving surface during the paving operation.

A drop arm position sensor 166 may be provided on a drop arm for any angular adjustment mechanism provided for the main screed section 134. Typically, the thickness adjustment mechanism includes a hand crank operated linkage that is operable to pivot the main screed section 134 and thereby change its pitch or angle of attack. Alternatively, the thickness adjustment could be powered by an actuator, such as a hydraulic or electric actuator. In addition to receiving information from these sensors, the controller 160 may also communicate with and be configured to control the actuators that drive these adjustments including the tow arm actuators 128, as shown in FIG. 3.

The position of the tow arms 126 and the screed lift cylinders 130 may be adjusted to achieve the user defined paving depth and the default angle of attack settings for starting the new paving operation, based on the sensed position of the drop arms, lift cylinders 130 and tow arms 126 when resting on grade with the screed lift cylinders 130 in the float mode. In an embodiment, the controller 160 may receive the sensed position parameters from the various sensors to determine the first reference position when the screed assembly 110 is in the float mode. Further, the controller 160 may use the first and the second reference positions of the screed assembly 110 to determine the amount of pressure to be applied to the tow arm actuators 128, and the screed lift cylinders 130. In an exemplary embodiment of the present disclosure, the controller 160 may be configured to control a hydraulic pressure supplied to the tow arm actuators 128, and the screed lift cylinders 130 to adjust the configuration of the screed assembly 110 to match to the user defined configuration parameters. Once the screed assembly 110 is prepared based on the user defined paving depth and the default angle of attack settings, the controller 160 then displays a confirmation message to the user indicating the screed assembly 110 prepared for the new paving operation, via the graphical user interface 162.

Furthermore, the controller 160 may be configured to maintain an optimal residual pressure supply to the screed lift cylinders 130 during the start of the paving operation to prevent unnecessary rising of the screed plate 132 during the paving operation. Once the machine 100 starts the paving operation, the controller 160 re-establishes the appropriate angle of attack by adjusting the respective actuators associated with the screed assembly 110. The angle of attack may be established and/or maintained according to terrain conditions on which the paving operation is to be performed. For example, the machine 100 may include a number of position sensors, proximity sensors etc., to determine the terrain conditions. Furthermore, the controller 160 may use the output signals from these sensors to adjust the tow arm actuators 128, and the screed lift cylinders 130 may be adjusted to re-establish the angle of attack. Furthermore, the pressure on the head end of the screed lift cylinders 130 is removed once the paving operation starts and/or the machine 100 moves for a predetermined distance and/or a predetermined time. Removing the residual pressure in the lift cylinders allows the screed to return to a truly free floating state once it has reached equilibrium at the proper paving angle of attack and the desired paving depth. In an aspect of the present disclosure, all other machine controls on the machine 100, such as grade and slope controls, may be activated once the screed assembly 110 has returned to its free floating mode and has reached an equilibrium at the desired angle of attack and paving depth.

INDUSTRIAL APPLICABILITY

In order to help achieve the desired uniform depth and smoothness as well as to accommodate different job site conditions and different desired roadbed configurations, screed assembly may be adjusted to various configurations. These adjustments may be used to vary, for example, the width and thickness of the mat as well as the degree of any crown. However, these adjustments may make setting up a screed assembly at the start of a new operation a time consuming and labor intensive process, leading to inefficiencies. Moreover, the set-up of the screed assembly may be relatively complicated, which may lead to errors in the set-up. These errors may result in defects in the mat such as inconsistencies or discontinuities in the compression of the mat and in the thickness, texture, density and smoothness of the mat.

The present disclosure is applicable to paving machines that include an adjustable screed assembly 110. The controller 160 and the user interface 162 may comprehensively automate the start up configuration process, and hence substantially save set up times for the paving machine 100. Moreover, as the configuration parameters are defined by the user via the graphical user interface 162 and the controller 160 automatically adjusts the various actuators of the screed assembly 110 to correspond to the user defined configuration parameters of the screed assembly 110, therefore, the system is substantially less prone to human calibration errors. Additionally, the controller 160 enables accurate start up configuration of the screed assembly 110, which minimizes mat 112 defects such as bumps, unevenness, etc., and facilitates even and smooth mat 112 surfaces, as well as minimizes defects between adjoining mats 112 from previous operations.

Figure 4:
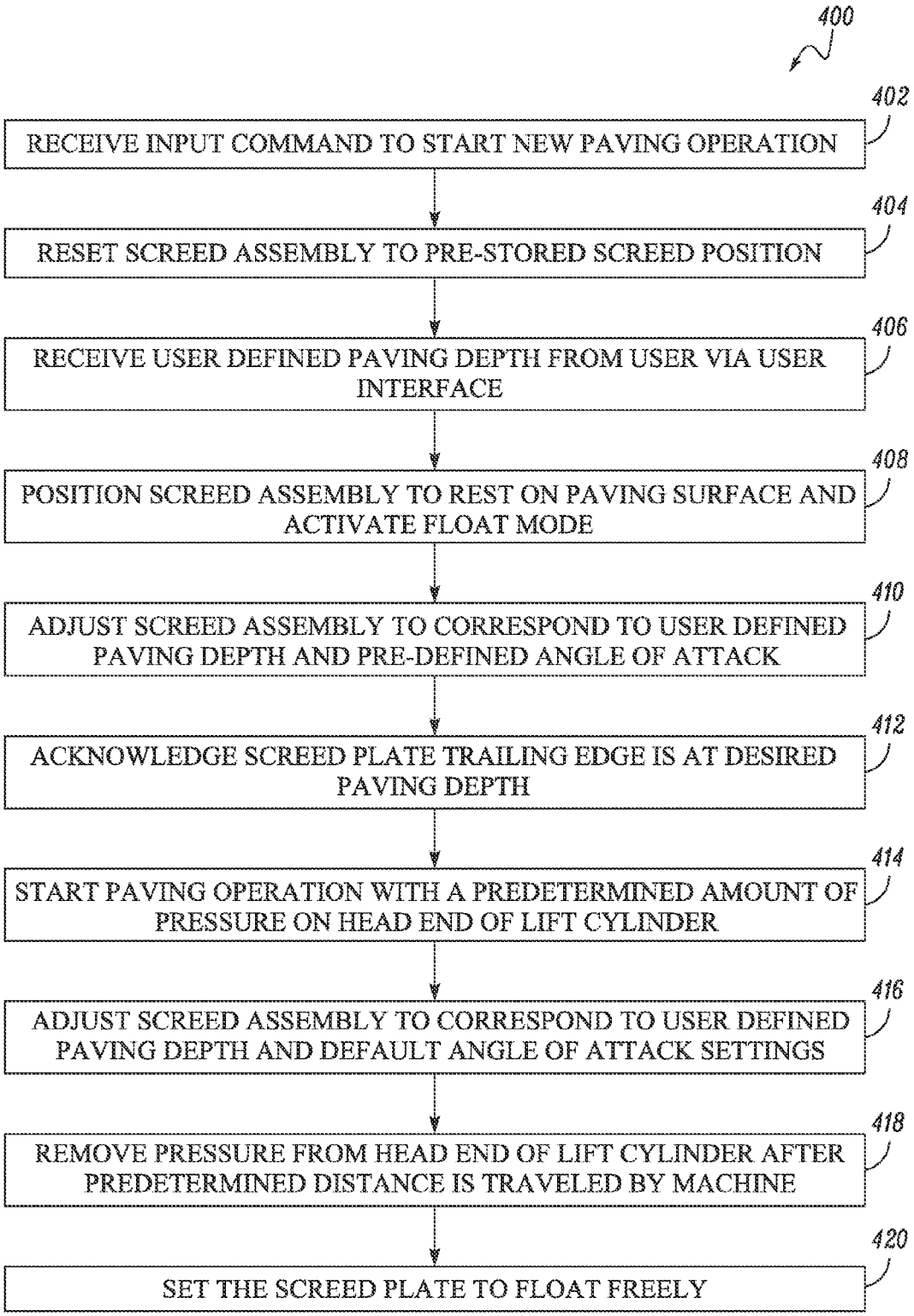
FIG. 4 is a flow chart for a method of preparing the screed assembly for a paving operation in accordance with the disclosure.

FIG. 4 illustrates an exemplary flowchart of a method 400 of preparing the paving machine 100 having the adjustable screed assembly 110 for the new paving operation. Initially at step 402, an input command to start the new paving operation is received. For example, the user may activate a "Start new paving operation" command displayed on the graphical user interface 162.

At step 404, the screed assembly 110 may be set to the pre-stored screed position, such as to the default settings of the screed assembly 110. The screed assembly 110 is set to the default settings so as to come to a standard starting point. In an exemplary embodiment, the user activates an "Activate default settings" command displayed on the graphical user interface 162. In response, the various actuators associated with the screed assembly 110 are automatically adjusted by the controller 160 to set the screed assembly to the default settings. For example, if the screed assembly 110 was working at a specific position and stopped at that specific position, such as at the end of a day or at the end of a paving operation, then on the next day or if a next paving operation is to be performed, the controller 160 brings the screed assembly 110 back to the default setting, prior to adjusting the screed assembly 110 based on the user defined position parameters. The default settings provide a standard starting point, from which the screed assembly 110 is adjusted for the new paving operation. If it is determined that there has been paving operation performed by the screed assembly 110 after the last activated default settings, then the user may be prompted to again activate the default settings of the screed assembly 110. However, if it is determined that there has been no paving operation performed since the last activated default settings, then the step 404 may be skipped, as the screed assembly 110 would already be in the default settings mode. In an exemplary aspect of the present disclosure, the controller 160 communicates with the various sensors associated with the screed assembly 110, to determine whether the screed assembly 110 is already in the default settings mode or needs to be set to the default settings mode.

At step 406, a user defined paving depth is received from the user via the graphical user interface 162. In an exemplary embodiment of the present disclosure, the user may enter and submit the user defined paving depth by activating the "Submit" command displayed on the graphical user interface 162. The paving depth indicates the desired thickness of the mat 112.

Further, at step 408, the screed assembly 110 is positioned to rest on the paving surface and the float mode is activated. For example, the user may be prompted by the controller 160 to set the screed assembly 110 to rest on the paving surface. The user may manually check and confirm the same by activating a "Confirm" command displayed on the graphical user interface 162. Further, the user is prompted to set the screed assembly 110 to the float mode, to facilitate the screed assembly 110 to float freely on the paving surface for the paving operation. Further, the user confirms the same by activating the "Confirm" command displayed on the graphical user interface 162. The position of the screed lift cylinder 130 in the float mode is stored as the first reference position.

At step 410, the screed assembly 110 is automatically adjusted to correspond to the user defined paving depth and predefined angle of attack settings. The second reference position is determined by the controller 160, based on the user defined paving depth and the pre-defined angle of attack. The position of the screed lift cylinders 130 is automatically adjusted by the controller 160 based on the first reference position and the second reference position. The controller 160 may also store the position of the screed lift cylinders 130 for the user defined paving depth as the second reference position. The controller 160 may adjust the screed assembly 110 by controlling the amount of hydraulic pressure supplied to the screed lift cylinders 130 to correspond to the user defined paving depth. Furthermore, the screed assembly 110 is automatically adjusted based on the predefined angle of attack settings. For example, the predefined angle of attack settings may be default angle of attack settings and may be pre-stored and/or pre-programmed in the controller 160. Further, the user is prompted to activate angle of attack setting. The controller 160 automatically adjusts the screed lift cylinders 130 and the tow arm actuators 128 to achieve the desired angle of attack. In an embodiment, the controller 160 may receive sensed position parameters from the various sensors to determine how much pressure needs to be applied on the actuators, such as the tow arm actuators 128 to adjust the position of the screed assembly 110. Furthermore, the screed plate 132 is raised to position the trailing edge of the screed plate 132 at the desired paving depth. The positioning of the tow arm actuators 128, and the screed lift cylinders 130 are governed by machine kinematics and resulting maps within the controller 160. For example, length and position of the tow arm actuators 128 and the screed lift cylinders 130 may be used by the controller 160 to determine how much the tow arm actuators 128 and the screed lift cylinders 130 are to be tilted and/or moved to achieve the desired angle of attack at the user programmed desired paving depth. Additionally, the position of the screed extender 144 may also be adjusted by controlling the height actuators 148, slope actuators 150 associated with the screed extender 144. Furthermore, the crown actuators 142 may also be controlled to achieve a desired crown of the mat 112. In an embodiment, the desired crown of the mat 112, configuration of the screed extender 144 may also be based on the user defined position parameters.

At step 412, it is acknowledged that the screed plate 132 trailing edge is correctly positioned at the desired paving depth, now that the screed has also been set to the correct starting angle of attack setting. The controller 160 automatically adjusts the screed lift cylinders 130 and the tow arm actuators 128 to position the trailing edge of the screed plate 132 to the desired paving depth. Further, the user may confirm that the trailing edge of the screed plate 132 is positioned at the desired paving depth by activating the "Submit" command displayed on the graphical user interface 162.

At step 414, the new paving operation is started with the machine having applied a predetermined amount of residual pressure on the head end of the screed lift cylinder 130. The residual pressure is maintained on the head end of the screed lift cylinder 130 at the start of a new paving operation under control of this defined control system algorithm. The residual pressure is maintained on the head end of the lift cylinders 130 to prevent the screed plate 132 from rising during the startup of the paving operation. For example, the controller 160 applies the residual pressure on the head end of the screed lift cylinder 130, when the controller 160 determines that a new paving operation is in process, i.e. the control system is enabled, the machine 100 is moving at a speed greater than zero and when the screed assembly 132 is set to the float mode.

Further, at step 416, the screed assembly 110 is automatically adjusted to maintain and/or re-establish the starting angle of attack settings after taking off and once the paving process has begun. The controller 160 may automatically adjust the screed assembly 110 to re-establish the angle of attack settings as a function of paving distance and lift cylinder pressure.

At step 418, the pressure on the head end of the screed lift cylinders 130 is gradually removed once the screed has reached an equilibrium point at the correct angle of attack and paving depth, with the paver having traveled a predetermined minimum distance. The minimum distance requirement is there to ensure the screed has reached its true equilibrium point before bleeding off the lift cylinder pressure.

At step 420, the screed assembly 110 is allowed to float freely. Removing the pressure from the head end of the screed lift cylinders 130 allows the screed 110 to return to a free floating state now that it has reached equilibrium at the proper paving angle of attack and the desired paving depth.

Furthermore, at step 422, all other controls present on the machine 100, such as slope and grade controls are automatically activated. For example, when the screed assembly 110 has returned to its free floating mode and reached equilibrium at the desired angle of attack and paving depth, the controller 160 may be configured to automatically activate the grade and slope control or automation system, if installed on the machine 100.

In an embodiment, an alarm is provided to the user of the machine 100 and the people standing in the vicinity of the machine 100, indicating that the start up configuration of the screed assembly 110 of the machine 100 is going on. Further, the alarm may also indicate that the screed assembly 110 is ready and the paving operation is going to start. The alarm may be an audio alarm, an audio-visual alarm, a textual alarm, etc.

While aspects of the present disclosure have been particularly shown and described with reference to the embodiments above, it will be understood by those skilled in the art that various additional embodiments may be contemplated by the modification of the disclosed systems and methods without departing from the spirit and scope of what is disclosed. Such embodiments should be understood to fall within the scope of the present disclosure as determined based upon the claims and any equivalents thereof.

What is claimed is:

1. A method for preparing a screed assembly for starting a new paving operation, the method comprising:

resetting the screed assembly to a pre-stored screed position in response to a user command;

receiving a user defined paving depth associated with the new paving operation;

positioning the screed assembly to rest on a paving surface in response to a user command;

activating a float mode of the screed assembly in response to a user command;

setting an angle of attack of the screed assembly associated with the new paving operation in response to a user command;

adjusting a height of the screed assembly based on the user defined paving depth; and providing a confirmation message to a user, the confirmation message is indicative of the screed assembly prepared for the new paving operation;

whereby the screed assembly is adjusted and calibrated before starting the new paving operation.

2. The method of claim 1 further comprising receiving a user command to start the new paving operation.

3. The method of claim 1, wherein adjusting the height of the screed assembly further comprises adjusting a trailing edge of the screed assembly based on the user defined paving depth.

4. The method of claim 1, wherein setting the angle of attack and adjusting the height of the screed assembly further comprises adjusting a plurality of actuators associated with a plurality of lift cylinders and tow arms associated with the screed assembly.

5. The method of claim 4 further comprising applying a predetermined amount of hydraulic pressure on a head end of the plurality of lift cylinders associated with the screed assembly prior to starting the new paving operation.

6. The method of claim 5 further comprising adjusting the amount of pressure applied to the plurality of actuators associated with the screed assembly to maintain the predefined angle of attack after the start of the new paving operation.

7. The method of claim 5 further comprising removing the predetermined amount of hydraulic pressure from the head end of the plurality of lift cylinders associated with the screed assembly after the start of the new paving operation.

8. The method of claim 1 further comprising activating a plurality of machine controls associated with the paving machine after the start of the new paving operation.

9. The method of claim 1 further comprising generating an alarm prior to providing the confirmation message.

10. A paving machine comprising:

a screed assembly;

a plurality of actuators associated with the screed assembly, the actuators being configured to adjust a position of the screed assembly;

a plurality of sensors each configured to sense a respective position parameters associated with the plurality of actuators, the position parameters indicative of the position of the screed assembly;

a user interface configured to prepare the screed assembly for a new paving operation, the user interface being configured to facilitate a user to:

provide a user command to start the new paving operation;

provide a user command to reset the screed assembly to a pre-stored screed position;

provide a user command to position the screed assembly to rest on a paving surface;

provide a user command to activate a float mode of the screed assembly;

provide a user command to set an angle of attack of the screed assembly associated with the new paving operation; and define a paving depth associated with the new paving operation; and a controller in communication with the sensors and the user interface, the controller being configured to:

receive one or more sensed position parameter from the plurality of sensors associated with the screed assembly;

determine a first reference position of the screed assembly based on the sensed position parameter from the plurality of sensors when the screed assembly is in the float mode;

determine a second reference position of the screed assembly based on the user defined paving depth and the pre-defined angle of attack;

adjust an amount of pressure applied to the plurality of actuators associated with the screed assembly based on the first reference position and the second reference position to set the screed assembly to the second reference position and to prepare the screed assembly for the new paving operation.

11. The paving machine of claim 10, wherein the controller is further configured to provide a message via the user interface, the message indicative of the prepared screed assembly for the new paving operation based on the user defined paving depth and the angle of attack.

12. The paving machine of claim 11, wherein the controller is configured to generate an alarm prior to providing the message via the user interface.

13. The paving machine of claim 10, wherein the controller is further configured to adjust a trailing edge of the screed assembly based on the user defined paving depth.

14. The paving machine of claim 10, wherein the controller is further configured to apply a predetermined amount of hydraulic pressure on a head end of the plurality of lift cylinders associated with the screed assembly prior to starting the new paving operation.

15. The paving machine of claim 14, wherein the controller is further configured to adjust the pressure supplied to the plurality of actuators to maintain the predefined angle of attack after the start of the new paving operation.

16. The paving machine of claim 14, wherein the controller is further configured to remove the predetermined amount of hydraulic pressure from the head end of the plurality of lift cylinders associated with the screed assembly after the start of the paving operation.

17. A paving machine comprising:

a screed assembly;

a plurality of tow arms and lift cylinders having respective actuators configured to adjust a position of the screed assembly;

a controller configured to adjust a pressure supplied to the actuators associated with the tow arms and the lift cylinders to:

reset the screed assembly to the pre-stored screed position in response to the user command to reset the screed assembly to the pre-stored screed position;

position the screed assembly to rest on the paving surface in response to the user command to position the screed assembly to rest on the paving surface;

activate the float mode in response to the user command to activate the float mode of the screed assembly;

set the angle of attack of the screed assembly in response to the user command to set the angle of attack associated with the new paving operation; and adjust a height of the screed assembly based on the user defined paving depth received via the user interface;

whereby the screed assembly is adjusted and calibrated before starting the new paving operation.

18. The paving machine of claim 17, wherein the controller is further configured to provide a message via the user interface, the message indicative of the prepared screed assembly for the paving operation.

19. The paving machine of claim 17, wherein the screed assembly includes a screed plate having a trailing edge and wherein the user interface is further configured to facilitate the user to adjust the trailing edge of the screed plate based on the user defined paving depth.

20. The paving machine of claim 17, wherein the user interface is further configured to facilitate the user to provide an acknowledgement indicative of the prepared screed assembly for the paving operation.

21. A paving machine comprising:

a screed assembly;

a lift cylinder to adjust a position of the screed assembly;

a controller configured to:

determine a residual pressure, which is used to lower the screed assembly into contact with a paving surface;

determine when the screed assembly starts a new paving operation;

determine when the screed assembly is in a float mode;

determine when a speed of the machine is greater than zero;

apply the residual pressure to the lift cylinder when the screed assembly starts the new paving operation, the screed assembly is in the float mode, and the speed is greater than zero.

22. The paving machine of claim 21, wherein the controller is further configured to remove the residual pressure when the machine travels a predetermined distance.

* * * * *